US006902471B2

(12) United States Patent
Krondorfer et al.

(10) Patent No.: US 6,902,471 B2
(45) Date of Patent: Jun. 7, 2005

(54) HEAVY-DUTY TOOL WITH A ROTATIONALLY DRIVEN, DISK-SHAPED HUB

(75) Inventors: Harald Krondorfer, Ludwigsburg (DE); Markus Heckmann, Filderstadt (DE); Joachim Schadow, Dettenhausen (DE); Christof Hoelzl, Schwaz (AT); Johann Huber, Kramsach (AT); Wilhelm Schulze, Vomp (AT)

(73) Assignees: Robert Bosch GmbH, Stuttgart (DE); Tyrolit Schleifmittelwerke Swarovski K.G., Schwaz (AT)

( * ) Notice: Subject to any disclaimer, the term of this patent is extended or adjusted under 35 U.S.C. 154(b) by 0 days.

(21) Appl. No.: 10/257,349

(22) PCT Filed: Jan. 23, 2002

(86) PCT No.: PCT/DE02/00202

§ 371 (c)(1),
(2), (4) Date: Apr. 21, 2003

(87) PCT Pub. No.: WO02/064316

PCT Pub. Date: Aug. 22, 2002

(65) Prior Publication Data

US 2003/0176153 A1 Sep. 18, 2003

(30) Foreign Application Priority Data

Feb. 15, 2001 (DE) ..... 101 06 979

(51) Int. Cl.[7] ..... B24D 5/00
(52) U.S. Cl. ..... 451/359; 451/540; 451/548
(58) Field of Search ..... 451/344, 353, 451/359, 490, 508, 533, 534, 540, 548; 125/13.01, 15

(56) References Cited

U.S. PATENT DOCUMENTS

| | | | | | |
|---|---|---|---|---|---|
| 2,278,301 | A | * | 3/1942 | Bauer | 451/548 |
| 2,652,321 | A | * | 9/1953 | Teague | 51/298 |
| 2,805,530 | A | * | 9/1957 | Schaffner | 451/490 |
| 2,882,139 | A | * | 4/1959 | Rock | 51/293 |
| 3,191,208 | A | * | 6/1965 | Churchill | 15/230.17 |
| 3,353,306 | A | * | 11/1967 | Seymour et al. | 451/342 |
| 3,362,114 | A | * | 1/1968 | Hurst | 451/508 |
| 3,500,592 | A | * | 3/1970 | Harrist | 451/508 |
| 3,667,169 | A | | 6/1972 | Mackay | |
| 3,793,783 | A | * | 2/1974 | Paterno et al. | 451/543 |
| 3,795,077 | A | * | 3/1974 | Bosma et al. | 451/543 |
| 3,795,078 | A | * | 3/1974 | Coes, Jr. | 451/543 |
| 3,889,430 | A | * | 6/1975 | Scandaletos | 451/546 |
| 4,177,611 | A | * | 12/1979 | Carr-Rollett | 451/508 |
| 4,251,955 | A | | 2/1981 | Shawke | |
| 4,439,907 | A | * | 4/1984 | Block et al. | 29/432.1 |
| 4,541,205 | A | * | 9/1985 | Patrello | 451/342 |
| 4,850,158 | A | * | 7/1989 | Schaffner | 451/466 |
| 5,138,735 | A | * | 8/1992 | Kusz et al. | 15/97.1 |
| 5,649,857 | A | * | 7/1997 | Suhrheinrich et al. | 451/466 |
| 5,806,132 | A | * | 9/1998 | Kelley | 15/230.17 |
| 6,071,185 | A | * | 6/2000 | Genau et al. | 451/541 |
| 6,116,996 | A | * | 9/2000 | Yanase | 451/359 |
| 6,136,143 | A | | 10/2000 | Winter et al. | |

FOREIGN PATENT DOCUMENTS

| | | | | |
|---|---|---|---|---|
| CH | 543 351 | | 4/1971 | |
| DE | 3112773 | A1 * | 10/1982 | B24D/9/08 |
| DE | 44 30 229 | A | 2/1996 | |

* cited by examiner

*Primary Examiner*—David B. Thomas
(74) *Attorney, Agent, or Firm*—Michael J. Striker

(57) ABSTRACT

The invention is based on an insertable tool having a rotationally drivable, disk-shaped hub (10, 12), on which a grinding means (14) forming a cutoff disk, grinding disk, roughing disk, or abrasive disk is secured in the radially outer region.

It is proposed that the grinding means (14) and the hub (10, 12) are joined via joining means (26) in the manner of a positive connection at least in the direction of rotation.

16 Claims, 2 Drawing Sheets

HEAVY-DUTY TOOL WITH A ROTATIONALLY DRIVEN, DISK-SHAPED HUB

BACKGROUND OF THE INVENTION

A disk-shaped insertable tool, e.g., a grinding disk or a cutoff disk for angle grinders, are usually composed entirely of bound grinding means and have a center, circular recess, via which the insertable tool can be secured on an angle grinder spindle with a clamping nut in non-positive fashion in the circumferential direction and in positive fashion in the axial direction. Insertable tools are known that have a reinforcement made of sheet metal in the region of the recess, and some are known that do not have a reinforcement.

SUMMARY OF THE INVENTION

The invention is based on an insertable tool having a rotationally drivable, disk-shaped hub on which a grinding means forming a cutoff disk, grinding disk, roughing disk, or abrasive disk is secured in the radially outer region.

It is proposed that the grinding means and the hub are joined via joining means in positive fashion at least in the direction of rotation. An advantageous connection can be achieved via which high drive torques can be transmitted securely from the hub to the grinding means. In addition to a positive connection in the direction of rotation, a positive connection in the axial direction is also feasible, e.g., by means of projections that are angled and/or bent at right angles. The positive connection can be realized with simple design means without additional components with projections on the hub extending in the axial direction and forming the joining means, which said projections grip axially in or through the grinding means and can be advantageously integrally molded on the hub in a stamping process, e.g., jointly with other recesses. An axial positive connection can take place—in the case of thin grinding means, in particular—by outwardly or inwardly bending integrally molded projections or borders gripping through the grinding means in a cost-effective fashion when the grinding means are pressed.

It is furthermore proposed that the hub is designed with a flexural strength that changes in the radial direction. An advantageous transition can be achieved between the grinding means and a harmonious bending line overall can be obtained. An advantageous coherence between the grinding means and the hub can be achieved and detachment can be securely prevented when attaching the insertable tool, e.g., on a spindle of an angle grinder, and during operation. Axial forces and resultant bending torques can be securely supported via a harmonious bending line.

A flexural strength and/or bending line can be specifically adapted to a desired course using simple design means by the shape of recesses installed in the radially outer region of the hub. The flexural strength of the hub can be specifically weakened in individual areas. The recesses can have various shapes that appear reasonable to one skilled in the art. The recesses can be designed as slits having a uniform width and/or with a width that decreases radially inwardly in continuous fashion or in stages, by way of which the flexural strength decreases radially outwardly due to the hub material that decreases radially outwardly.

In a further embodiment of the invention it is proposed that at least one recess has a greater width in the radially inward region than in the radially outward region, by way of which an advantageously large fastening area is provided in the radially outer region and, in the adjacent radially inner region, a type of spring area can be obtained. The recesses are advantageously designed open in the radially outward direction, by way of which segments can be advantageously obtained that can be deflected largely independent of each other. Basically, however, the recesses could also be designed closed in the radially outward direction.

Instead of recesses, other design embodiments appearing reasonable to one skilled in the art are feasible for achieving a certain bending line, such as embodiments having material strengths that increase or decrease radially outwardly, different numbers of material layers, different materials with different stiffness and/or with reinforcement ribs for setting a desired bending line. Furthermore, materials are feasible that were subjected to different material treatments radially outwardly.

The hub is advantageously produced in cost-effective and environmentally-friendly fashion out of sheet metal, preferably steel sheet. The grinding means, which is often difficult to recycle, can be used up completely, and the hub can simply be recycled. Basically, however, other hub materials are feasible as well, such as plastics, ceramic materials, etc.

In a further embodiment of the invention it is proposed that the hub is covered at least partially on both sides with at least one layer of the grinding means, e.g., with a fabric layer carrying an abrasive substance, or fiberglass mats, etc., by way of which the connection between the hub and the grinding means can be improved. A positive connection can be achieved in both axial directions.

A connection between the hub and the grinding means can be further improved by jointly subjecting the grinding means and the hub—during a production process of the grinding means—to at least one heating process, and/or by connecting the grinding means with the hub via a bonded connection in addition to a non-positive and/or positive connection, e.g., via an adhesive connection in particular. The bonded connection can be created after or during the production process of the grinding means. If the production process of the grinding means is used to join the hub and the grinding means, additional working steps can be spared, and a production process of the insertable tool that is more streamlined overall can be obtained. A bonding process in particular can be easily integrated in the production process of the grinding means, whereby other bonded connections are feasible as well, however, such as soldered and/or welded connections, etc.

The means of attaining the object according to the invention can be used with insertable tools that are secured on the spindle via a clamping nut, and particularly advantageously with hubs that have—in addition to a center recess—recesses for fixation via a quick-release system. During installation on a spindle, any installation forces that occur in the axial direction can be advantageously absorbed via a harmonious bending line.

Further advantages result from the following description of the drawings. Exemplary embodiments of the invention are presented in the drawings. The drawing, the description, and the claims contain numerous features in combination. One skilled in the art will advantageously consider them individually as well and combine them into reasonable further combinations.

DESCRIPTION OF THE PREFERRED EMBODIMENTS

Figure 1:
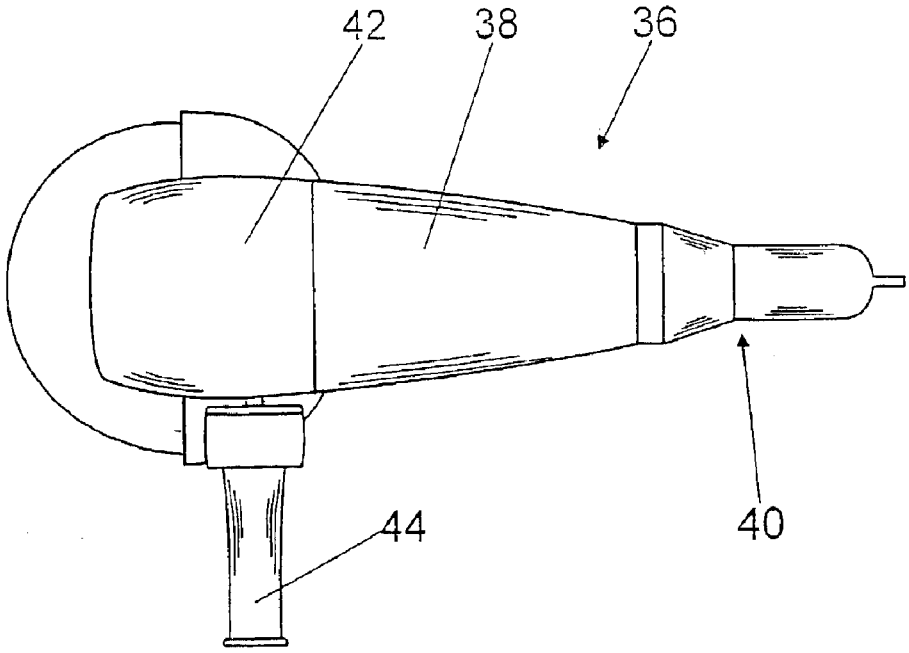
FIG. 1 shows a schematic illustration of an angle grinder from above.

FIG. 1 shows an angle grinder 36 from above with an electric motor supported in a housing 38 and not shown in further detail. The angle grinder 36 is capable of being guided via a first handle 40 integrated on the side furthest away from the insertable tool and extending in the longitudinal direction, and via a second handle 44 attached to a gearbox housing 42 in the region of the insertable tool and extending transversely to the longitudinal direction.

Figure 2:
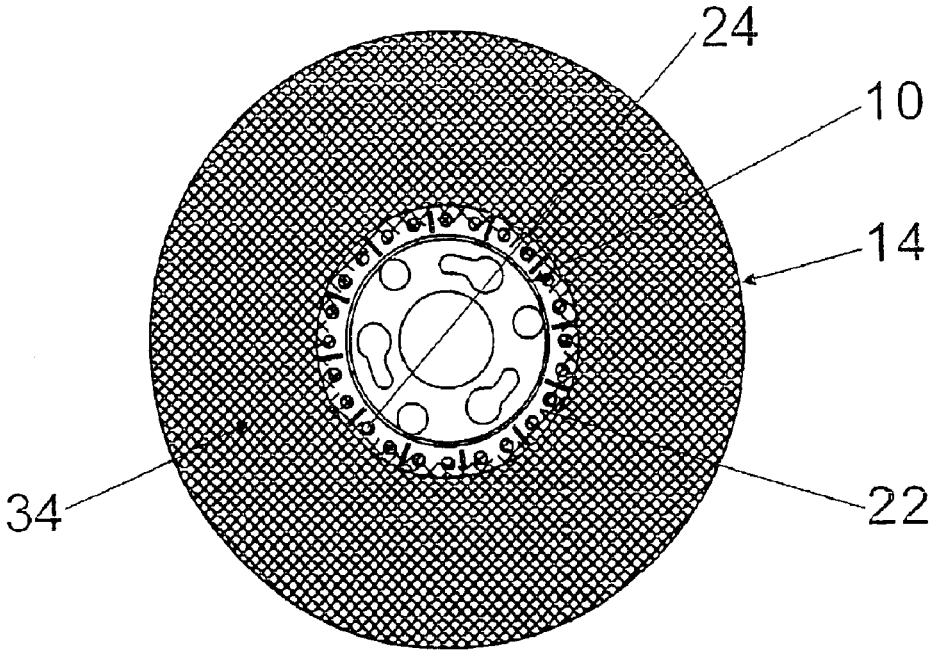
FIG. 2 shows an insertable tool according to the invention.

FIG. 2 shows the insertable tool in FIG. 1 in the removed state. The insertable tool has a rotationally drivable, disk-shaped hub 10 made of steel sheet to which a grinding means 14 forming a grinding disk is attached in the radially outward region. The grinding means 14 is essentially composed of fiberglass mats, grinding means and binding means that are pressed together to form a solid disk, whereby the binding means were set in a heating process.

The hub 10 is designed with a changing flexural strength in the radial direction, whereby the hub 10 is specifically weakened in its radially outward region to adjust the flexural strength using slit-shaped recesses 16. The recesses 16 are designed open in the radially outward direction, by way of which segments that can be deflected advantageously largely independently of each other are produced. The recesses 16 have a uniform width and project radially inwardly until shortly before a region in which recesses 30, 32 are installed to secure the insertable tool to an angle grinder spindle via a quick-release system. A circular recess 28 is installed in the center region of the hub 10 to center the insertable tool.

Figure 4:
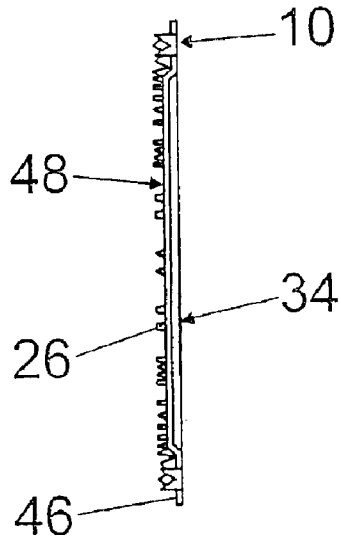
FIG. 4 shows the hub in FIG. 3 in a side view.

The hub 10 is covered on both sides by at least one layer 22, 24 of the grinding means 14, whereby the grinding means 14—with essentially its entire thickness—are located in an annular indentation on a side 48 facing the angle grinder, so that the hub 10 and the grinding means 14 advantageously meet in a common plane in the direction of the angle grinder 36. If the grinding means 14 should detach from the hub 10 during operation, they are still secured by the hub 10 against coming loose in the direction away from the angle grinder 36 (FIGS. 2 and 4). On a side 34 facing away from the angle grinder 36, a layer 22—formed by a fiberglass mat—of the grinding means 14 covers the hub 10 radially inwardly.

The grinding means 14 and the hub 10 are joined in the manner of a positive connection via joining means 26 in the direction of rotation (FIG. 4). The joining means 26 are formed by projections integrally molded on the hub 10 and extending in the axial direction, which said projections grip into and/or through the grinding means 14. The projections forming the joining means 26 are integrally molded with the recesses 16, 28, 30, 32 in a common stamping process.

During the production process of the grinding means 14, the hub 10 and the grinding means 14 are subjected to a joint heating process, whereby a bonded connection between the grinding means 14 and the hub 10—in fact, an adhesive connection—is set.

Figure 3:
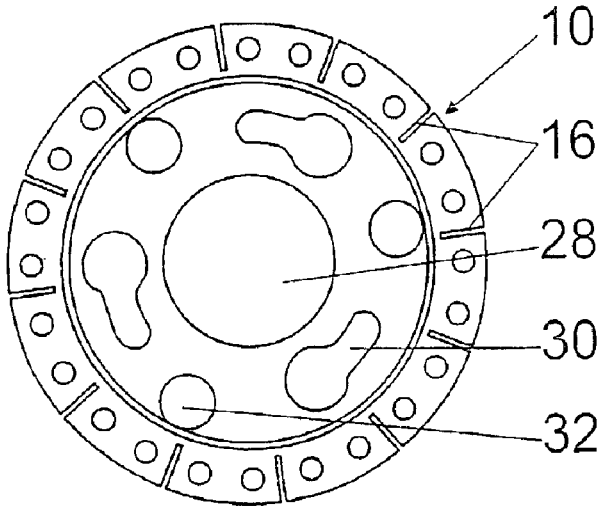
FIG. 3 shows an enlarged drawing of a hub without the grinding means, from above.
Figure 5:
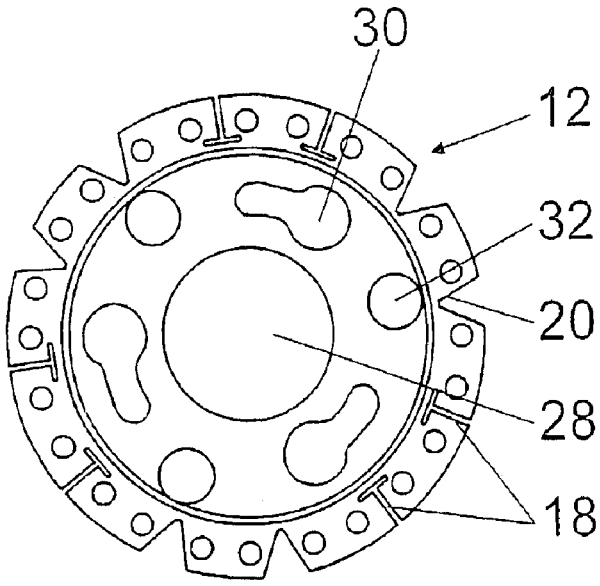
FIG. 5 shows an alternative to FIG. 3.

An alternative hub 12 is shown in FIG. 5. Components that essentially remain the same are basically labelled with the same reference numerals. Moreover, the description of the exemplary embodiment in FIGS. 2 and 3 can be referred to with regard for identical features and functions.

The hub 12 has recesses 18, 20 that are designed open in the radially outward direction and that have different widths in the radial direction. The recesses 18 are designed in the shape of a tee and have a greater width in the radially inner region than in the radially outward region. In contrast, the recesses 20 are designed in the shape of a vee and have a width that decreases radially inwardly.

In FIG. 5 the recesses 18 and 20 are combined, whereby it is also feasible, however, to provide the recesses 18 or 20 each on just one hub.

What is claimed is:

1. An insertable tool having a rotationally drivable, disk-shaped hub (10, 12) on which a grinding means (14) forming a cutoff disk, grinding disk, roughing disk, or abrasive disk is secured in the radially outer region,
wherein the grinding means (14) and the hub (10, 12) are joined via joining means (20) in the manner of a positive connection at least in the direction of rotation, wherein on a side (48) facing an angle grinder (36) projections extending in the axial direction and forming the joining means (26) are integrally molded on the hub (10, 12), which said projections grip completely through the grinding means (14).

2. The insertable tool according to claim 1,
wherein the grinding means and the hub are joined via at least one joining means in the axial direction in the manner of a positive connection.

3. The insertable tool according to claim 1,
wherein the hub (10, 12) is designed with a flexural strength that changes in the radial direction.

4. The insertable tool according to claim 1,
wherein recesses (16, 18, 20) for adjusting the flexural strength are installed in the radially outer area of the hub (10, 12).

5. The insertable tool according to claim 4,
wherein at least individual recesses (16, 18, 20) are designed open in the radially outward direction.

6. The insertable tool according to claim 1,
wherein at least one recess (18) has a greater width in the radially inner region than in the radially outer region.

7. The insertable tool according to claim 1,
wherein the hub (10, 12) is formed out of sheet metal.

8. The insertable tool according to claim 1,
wherein the hub (10, 12) is covered on both sides with at least one layer (22, 24) of the grinding means (14).

9. The insertable tool according claim 1,
wherein, in a production process of the grinding means (14), the grinding means (14) and the hub (10, 12) are subjected jointly to at least one heating process.

10. The insertable tool according to claim 1,
wherein the grinding means (14) and the hub (10, 12) are joined via a bonded connection.

11. The insertable tool according to claim 10,
wherein the grinding means (14) and the hub (10, 12) are adhesively bonded.

12. The insert tool according to claim 1, wherein the grinding means (14) are located in an annular indentation on a side (48) facing an angle grinder (36), so that the hub (10) and the grinding means (14) meet in a common plane in the direction of the angle grinder (36).

13. The insert tool according to claim 12, wherein a mounting surface for mounting the insert tool to the angle grinder (36) is arranged in the common plane.

14. The insert tool according to claim 13, wherein the common plane is a plane which is a farthest plane from the insert tool in a direction to the angle grinder.

15. An insertable tool having a rotationally drivable, disk-shaped hub (10, 12) on which a grinding means (14) forming a cutoff disk, grinding disk, roughing disk, or abrasive disk is secured in the radially outer region, wherein the grinding means (14) and the hub (10, 12) are joined via joining means (26) in the manner of a positive connection at least in the direction of rotation, wherein at least one recess (20) has a smaller width in the radially inner region than in the radially outer region.

16. An insertable tool having a rotationally drivable, disk-shaped hub (10, 12) on which a grinding means (14) forming a cutoff disk, grinding disk, roughing disk, or abrasive disk is secured in the radially outer region, wherein the grinding means (14) and the hub (10, 12) are joined via joining means (26) in the manner of a positive connection at least in the direction of rotation, wherein the hub (10, 12), in addition to a center recess (28), has a recess (30, 32) for fixation via a quick-release system.

* * * * *